US005395063A

United States Patent [19]

Schrödl

[11] Patent Number: 5,395,063

[45] Date of Patent: Mar. 7, 1995

[54] HAMMER BAR FOR USE IN A ROTOR OF A CRUSHER

[76] Inventor: Hermann Schrödl, Vornwald 7, A-4713 Gallspach, Austria

[21] Appl. No.: 88,324

[22] Filed: Jul. 7, 1993

[30] Foreign Application Priority Data

Jul. 28, 1992 [AT] Austria ..... 1532/92

[51] Int. Cl.[6] ..... B02C 13/00

[52] U.S. Cl. ..... 241/195; 144/218

[58] Field of Search ..... 241/191, 195, 197; 144/218

[56] References Cited

U.S. PATENT DOCUMENTS 3,784,117 1/1974 Koenig et al. ..... 241/195
4,597,538 7/1986 Getz .

FOREIGN PATENT DOCUMENTS 0224836 10/1990 European Pat. Off. .
678428 9/1952 United Kingdom ..... 241/195
2128499 5/1984 United Kingdom .

*Primary Examiner*—Douglas D. Watts
*Attorney, Agent, or Firm*—Collard & Roe

[57] ABSTRACT

A hammer bar for use in a rotor of a crusher comprises a body, which is adapted to be mounted in the rotor to extend parallel to the axis of the rotos, and tools, which are detachably mounted on the body and comprise each at least one retaining rail extending in a longitudinally extending retaining groove formed in the body. To facilitate the insertion and removal of the tools, the body consists of two parts, which define between them a joint extending along and adjoining said retaining groove, and clamping means are provided for clamping said body parts against each other at said joint.

6 Claims, 2 Drawing Sheets

HAMMER BAR FOR USE IN A ROTOR OF A CRUSHER

FIELD OF THE INVENTION

This invention relates to a hammer bar for use in a rotor of a crusher, which bar comprises a body, which is adapted to be mounted in the rotor to extend parallel to the axis of the rotor, and tools, which are detachably mounted on the body and comprise each at least one retaining rail extending in a longitudinally extending retaining groove formed in the body.

BACKGROUND OF THE INVENTION

Hammer bars composed of a body and of tools have proved most satisfactory because the tools have a high wear resistance and are replaceable so that such bars have a stron cleaving action and a lone life. These results depend on the provision of a sufficiently strong and durable joint between the tools and the body. For this purpose, as is apparent from EP-B-0 224 836, the tools are provided with one or more retaining rails, which is or are rounded in mushroom shape and slidably inserted in longitudinally extending retaining grooves formed in the body, and the retaining rail and the retaining groove have complementary cross-sectional shapes so that the tools and the body are interconnected by a positive joint, which is fracture-proof and has a high load-carrying capacity. In the operational use of such a hammer bar, dust evolved as a result of the comminuting work of the crusher will inevitably enter the gaps and cavities left between the retaining groove and the retaining rail and such clearances will eventually be completely filled with dust so that the removal and replacement of the tools will be rendered more difficult after a prolonged operation and expensive special machines, such as presses, are often required for such removal and replacement.

SUMMARY OF THE INVENTION

It is an object of the invention to eliminate the disadvantages outlined hereinbefore and to provide a hammer bar which is of the kind described first hereinbefore and distinguishes in that its tools can easily be mounted and removed whereas the cleaving action and service life of the bar are not adversely affected.

That object is accomplished in accordance with the invention in that the body consists of two parts, which define between them a joint extending along and adjoining said retaining groove, and clamping means are provided for clamping said body marts against each other at said joint. That longitudinally divided body, the parts of which can be clamped together, permits the retaining groove to be widened or narrowed by a proper operation of the clamming means so that a sufficiently large clearance for the insertion and removal of the tools can be provided and the required positive joint between the tools and the body can be established. If the body is properly divided and its parts are properly clamped together, a non-positive joint between the tools and the body can be established in addition to the positive joint. Regardless of the degree to which the gaps and cavities are soiled or filled with dust, the tools can easily be replaced even after a prolonged operation in that the clamping means are released. The design of the clamping means and the shame of the parts of the body are of minor significance and may be selected in dependence on the conditions encountered and the requirements to be met in each case.

The parts of the body might be clammed together by clamping screws or similar clamping means. Put it will be desirable to provide clamping means which comprise clamping drive means for applying pressure to the parts of the body, which contact each other at the joint and have outside engaging surfaces in contact with supporting members which are fixed to the rotor. Such clamping means may be designed to be very strong and may be used to apply strong clamping forces by inexpensive means and permit the parts of the body to be clamped not only against each other but also against supporting members which are fixed to the rotor so that the retention of the hammer bar in the rotor may also be improved by the clamping means.

If the rotor comprises as an abutment for the clamping drive means an axially extending supporting plate, which is radially inwardly spaced from the supporting members, and the supporting members have radially outwardly tapering wedge surfaces for contacting the parts of the body, a simple design will be obtained because the rotor is reinforced by the supporting plates and the clamping drive means can be supported by the supporting plates throughout the axial length of the rotor, which usually comprises axially spaced apart, juxtaposed disks for receiving the hammer bars. Owing to the radially outwardly tapering wedge surfaces, a reliable retention will be obtained because the clamping action will be assisted by centrifugal force as the rotor is rotating.

If substantially radially extending clamping drive means, particularly hydraulic or screw drive means, are provided, it will be possible to provide rather compact clamping means, which may comprise, e.g., pressure-applying hydraulic cushions.

To permit a distribution of the clamping forces in accordance with the design or in dependence on the loads to be expected and of the forces exerted on the parts of the body, it is possible to provide juxtaposed clamping wedges, which are axially spaced apart, or separate clamping wedges may be associated with each part of the bony, or the clamping wedges may be offset in the peripheral direction of the rotor, or each part of the body may be composed of juxtaposed sections, which are longitudinally spaced. Said measures may be adopted individually or in various combinations to provide a hammer bar which entirely complies with the requirements to be met in a given case.

DETAILED DESCRIPTION OF THE PREFERRED EMBODIMENTS

Figure 1:
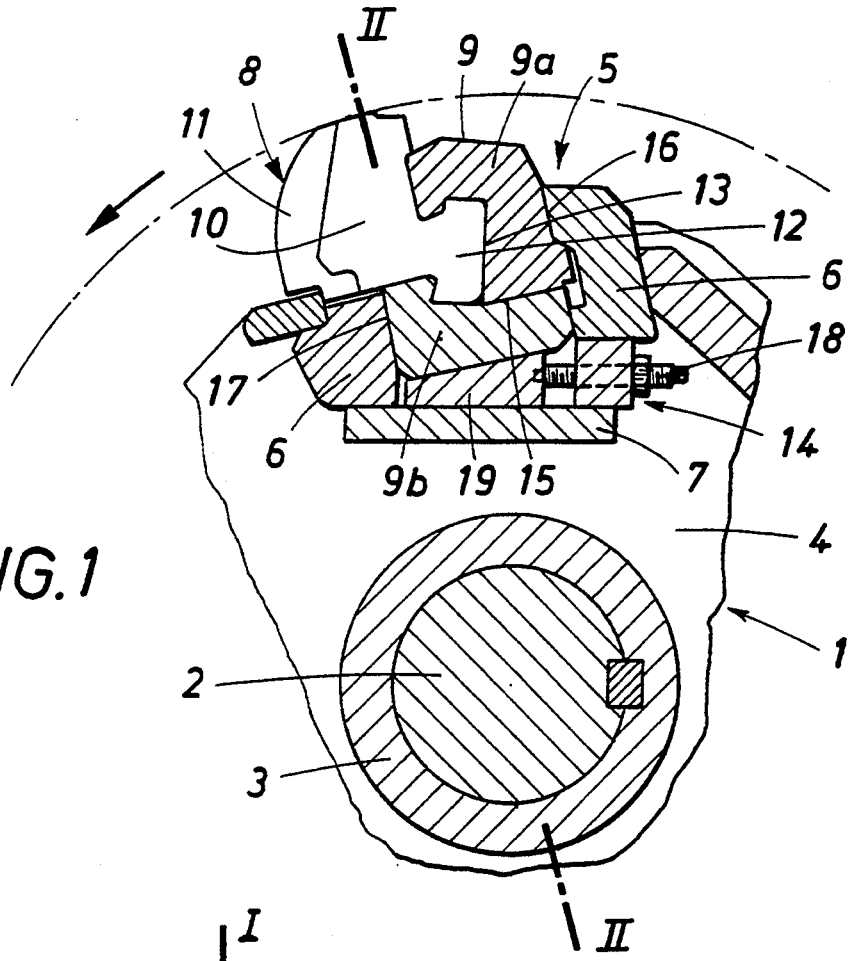
FIG. 1 is a transverse sectional view taken on line I—I in FIG. 2 in a direction which is normal to the axis of the rotor of a crusher and shows a hammer bar in accordance with the invention which has been inserted into said rotor.

Illustrative embodiments of the invention will be described hereinafter with reference to the drawing.

A merely schematically indicated rotor 1 of a crusher comprises a rotor sleeve 3, which is non-rotatably keyed to a drive shaft 2 and at each end carries a rotor disk 4, which is formed in its periphery with holders 5 for axially extending hammer bars 8. Each holder comprises a supporting member 6 and a supporting plate 7. Each hammer bar 8 is composed of a body 9 and tools 10, which comprise cutter bits 11 that extend transversely to the axis of the rotor. Each tool 10 also comprises a retaining rail 12, which is approximately mushroom-shaped in cross-section and extends in a longitudinally extending retaining groove 13 formed in the body 9. Said tools may be replaced in case of need by removing the tools 10 from and inserting them into the associated retaining grooves 13 so that the comminuting action of the crusher can be increased by the selection of proper tools and the service life of the hammer bars can considerably be increased by the use of cutter bits 11 made of wear-resistant material.

To facilitate the insertion and removal of the tools 10 in spite of the fact that the removal of the tools is rendered particularly difficult by dust accumulated during operation in the cavities between the retaining bar 12 and the retaining groove 13, the body 9 is divided into two body parts 9*a*, 9*b* along a joint 15 that extends along and adjoins the retaining groove 13, and clamping means 14 are provided for clamping the parts 9*a*, 9*b* of the body against each other at the joint 15. Said clamping means 14 are operable to apply pressure to the body parts 9*a*, 9*b*, which contact each other at the joint 15 and have outside engaging surfaces 16, 17, which engage the supporting members 6 of the holders 5 of the rotor. Upon an actuation of the clamping means 14 to relax the pressure on body parts 9*a*, 9*b* the retaining groove 13 will be widened to eliminate the positive joint so that the tools 10 can easily be removed by axially pulling the retaining rails 12 out of the retaining groove 13. To insert the tools 10, the retaining rails 12 are inserted into the retaining groove 13 and the clamping means 14 are actuated to apply force so that the body parts 9*a*, 9*b* are clamped together to establish a reliable positive joint between the tools and the body. The parts 9*a*, 9*b* of the body may be so designed and supported that the tools 10 are also non-positively joined to the body 9 and the entire hammer bar 8 is clamped in the holder 5.

Figure 2:
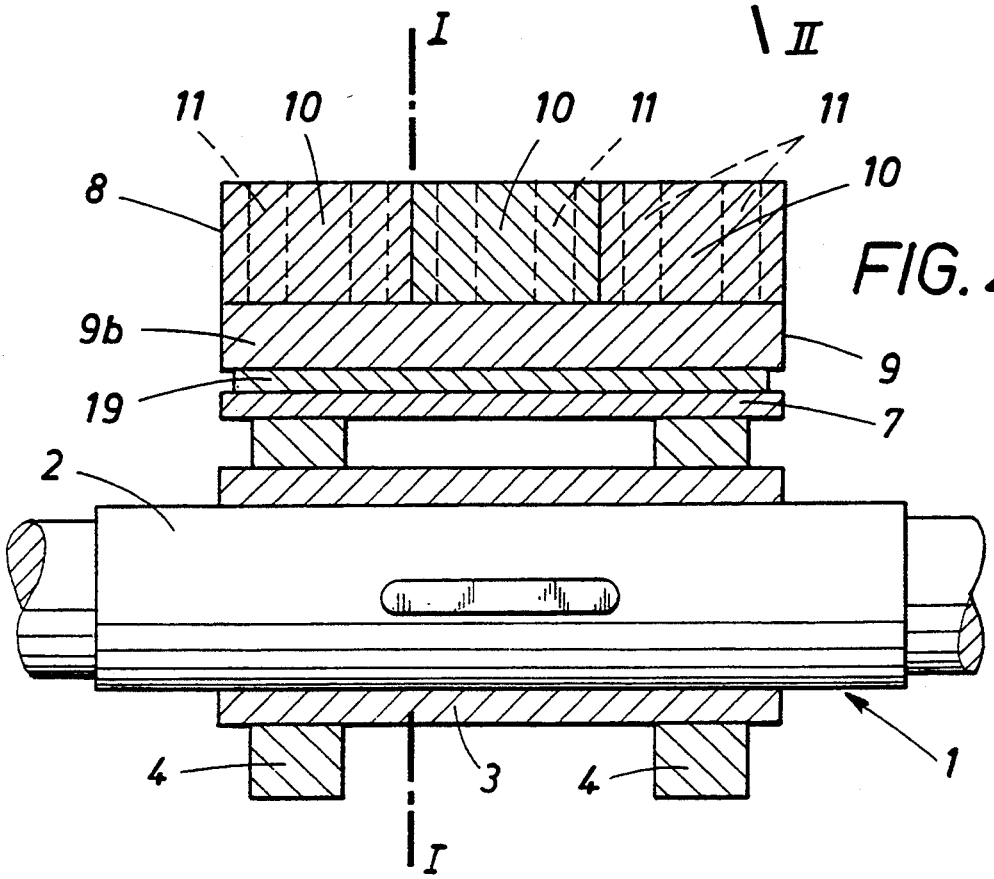
FIG. 2 is an axial sectional view taken on line II—II in FIG. 1.

In the embodiment shown in FIGS. 1 and 2 the clamping means 14 comprise a screw drive 18 and a clamping wedge 19, which extends between and acts on the supporting plate 7 and the part 9*b* of the body. In this case the joint 15 of the body 9 extends substantially along a tangential plane so that the clamping wedge 19 forces the body 9 by means of the lower part 9*b* of the body against the supporting members 6.

Figure 3:
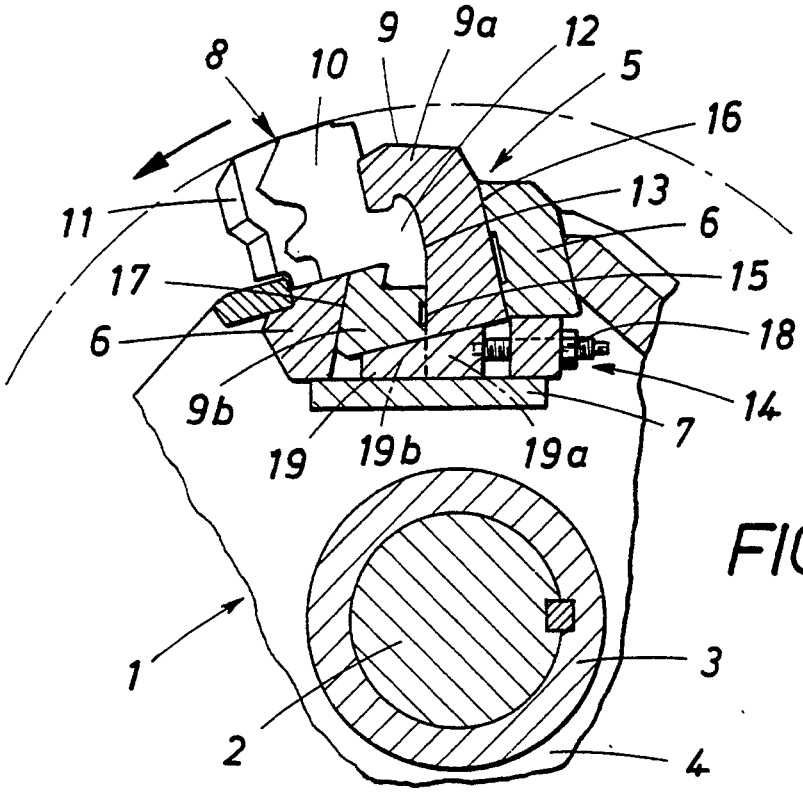
FIG. 3 and 4 are transverse sectional views taken at right angles to the axis of the rotor, like FIG. 1, and illustrate respective additional illustrative embodiments of a hammer bar in accordance with the invention.

In the embodiment shown in FIG. 3 the clamping means 14 comprise also a screw drive 18 and at least one clamping wedge 19 but in this case the joint 15 of the body 9 extends substantially in a radial plane so that the clamping wedge 19 cooperates with both parts 9*a*, 9*b* of the body 9. As is indicated the clamping wedge 19 might be bipartite in this case and a separate clamping wedge 19*a*, 19*b* might be associated with each part 9*a*or 9*b* of the body.

Figure 4:
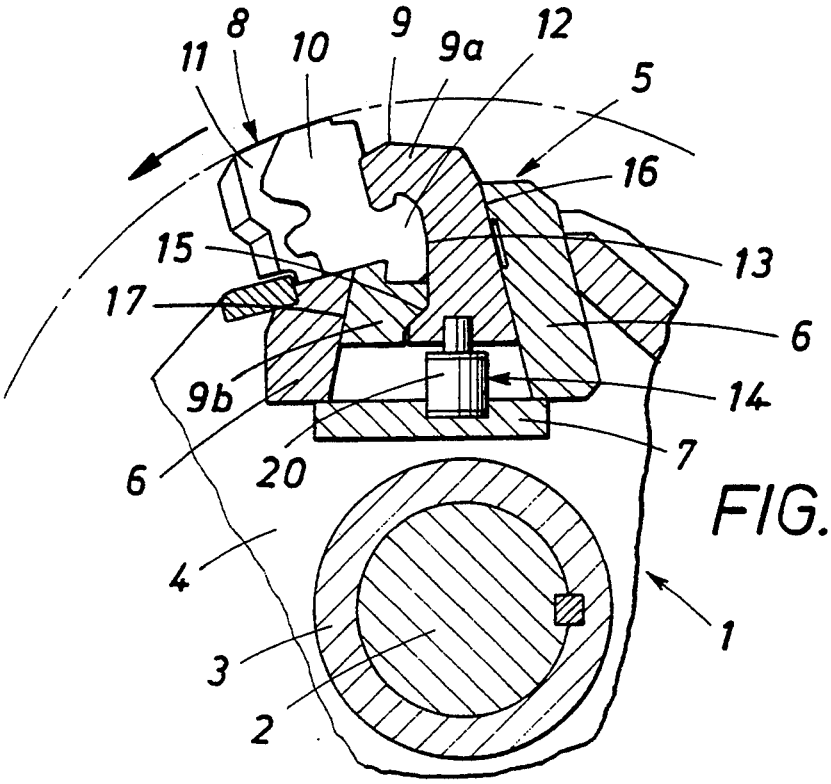

In the illustrative embodiment shown in FIG. 4 the clamping means 14 comprise a radially extending clamping drive 20, which preferably consists of a hydraulic drive and extends between the supporting plate 7 and one (9*a*) of the body parts and can be actuated to hold the parts of the body together as desired.

The simple measure which resides in that the body 9 is divided at a longitudinally extending joint 15, which extends along and adjoins the retaining groove 13, and that the parts 9*a* and 9*b* of the body are clamped together by suitable clamping means 14, has the result that the tools 10 are effectively held in the body 9 by a positive joint and a non-positive joint. Said clamping means may be sufficiently opened in case of need to facilitate the insertion and removal of the tools. The specific design and arrangement of the clamping means 14 and the number of parts into which the body 9 is divided are not essential because even small movements of the parts of the body relative to each other will be sufficient to permit a movement of the retaining rail in the retaining groove so as to simplify the insertion and removal of the tools, which is the only criterion to be met.

I claim:

1. A hammer bar for use in a rotor of a crusher, the rotor having a drive shaft extending in an axial direction, and the hammer bar comprising (a) an elongated body extending in the axial direction and defining a retaining groove extending in said direction, the elongated body consisting of (1) two body parts defining therebetween a joint extending along the retaining groove in said direction, the joint dividing the elongated body into said two body parts, (b) supporting members engaging outer surfaces of the body parts, (c) a supporting plate extending in the axial direction between the supporting members and radially inwardly of the outer body part surfaces, (d) a plurality of tools juxtaposed in said direction along said retaining groove, each of said tools comprising (1) a retaining rail engaging said retaining groove, and (e) clamping means comprising drive means arranged between the supporting plate and supporting members for pressing the outer surfaces of the body parts against the supporting members and the body parts against each other at said joint whereby the two body parts are wedged between the supporting members.

2. The hammer bar of claim 1, wherein the drive means comprises substantially tangentially extending drives and wedges arranged between the supporting plate and the elongated body, the wedges being driven by the drives.

3. The hammer bar of claim 2, wherein the drives are screw drives.

4. The hammer bar of claim 2, wherein the wedges are juxtaposed in the axial direction.

5. The hammer bar of claim 2, wherein a respective one of the wedges is associated with each one of the body parts.

6. The hammer bar of claim 1, wherein the drive means comprises radially extending drives.

* * * * *